US008887921B2

(12) United States Patent
Mohanka

(10) Patent No.: US 8,887,921 B2
(45) Date of Patent: Nov. 18, 2014

(54) SCREEN PANEL WITH WEAR PROTECTIVE APERTURES

(75) Inventor: Madan M. Mohanka, Kolkata (IN)

(73) Assignee: TEGA Industries Limited, Kolkata (IN)

( * ) Notice: Subject to any disclaimer, the term of this patent is extended or adjusted under 35 U.S.C. 154(b) by 143 days.

(21) Appl. No.: 13/520,931

(22) PCT Filed: Sep. 13, 2010

(86) PCT No.: PCT/IN2010/000611

§ 371 (c)(1),
(2), (4) Date: Oct. 3, 2012

(87) PCT Pub. No.: WO2011/086572

PCT Pub. Date: Jul. 21, 2011

(65) Prior Publication Data

US 2013/0026080 A1 Jan. 31, 2013

(30) Foreign Application Priority Data

Jan. 14, 2010 (IN) ..... 31/KOL/2010

(51) Int. Cl.
*B07B 1/49* (2006.01)
*B07B 1/46* (2006.01)

(52) U.S. Cl.
CPC ..... *B07B 1/4609* (2013.01)
USPC ..... 209/397; 209/392; 209/398; 209/399; 209/400; 209/402

(58) Field of Classification Search
USPC ..... 209/392, 397, 398, 399
See application file for complete search history.

(56) References Cited

U.S. PATENT DOCUMENTS 1,718,385 A * 6/1929 Sherwood ..... 209/397
4,757,664 A * 7/1988 Freissle ..... 52/509

FOREIGN PATENT DOCUMENTS

AU 589007 B2 * 11/1987 ..... B07B 1/48
AU 589007 B2 9/1989
FR 2031091 A5 11/1970
WO WO-2009101481 A1 8/2009
WO WO 2009101481 A1 * 8/2009 ..... B07B 1/46

OTHER PUBLICATIONS

International Search Report for PCT/IN2010/000611, dated Feb. 1, 2011.

* cited by examiner

*Primary Examiner* — Terrell Matthews
(74) *Attorney, Agent, or Firm* — Edwards Wildman Palmer LLP; Joshua L. Jones; Christopher J. Cillié

(57) ABSTRACT

A screen panel with wear protective apertures for mining and quarrying industries adapted to be mounted on a screen deck, including a screening surface made up of materials such as herein described formed on a reinforcing frame, said screening surface having suitably designed apertures of desired shape for allowing materials of desired size to pass through, said apertures having walls made of abrasion resistant material such as herein described said walls having plurality of slits(1) cut along the vertical as well as horizontal line in the top and bottom portion of the apertural walls, whereby utmost flexibility of the apertures is ensured simultaneously ensuring wear protection.

14 Claims, 4 Drawing Sheets

SCREEN PANEL WITH WEAR PROTECTIVE APERTURES

CROSS-REFERENCE TO RELATED APPLICATIONS

This application is a U.S. National Stage application under 35 U.S.C. 371 of International Application No. PCT/IN2010/000611 which claims priority to Indian Patent Application No. 31/KOL/2010, filed Jan. 14, 2010, each of which is hereby incorporated by reference herein in its entirety.

FIELD OF THE INVENTION

The present invention in general relates to screening arrangement for screening/separating or grading of minerals in the mining and quarrying industries and in particular to screen panels with wear protective apertures.

BACKGROUND OF THE INVENTION

Screening panel system for ore screening decks that is now widely used by the mining Industry, replaced the earlier screening cloths and large wire screening frames. These screening panels are known to be either of Rubber or Polyurethane with steel reinforcements. It is also known that such panels are manufactured by hot vulcanized method or casting. The panels are adapted to be secured with the support frame of the screen machine by bolting. The panels may also be secured to the frame with an alternate method using a pin and separate lug arrangement.

The screen panels known in the art, as described aforesaid, suffer from extensive wearing of the aperture walls due to constant passage of undersized ores through them during operation. This extensive abrasion/wearing of the aperture walls results in substantially expedited loss in the desired shape of the apertures, rendering them unfit for the desired operational purposes. Research is on in this area for considerably long period of time to reduce the abrasion of the aperture walls, so that, the desired shapes thereof may be retained for a considerably long period of time and the concerned screen panels are not rendered ineffective, rather briskly, as is regularly known to happen at present. However, significant breakthrough in that perspective is yet to be achieved.

Accordingly there was a long felt need to design screen panels for its application in mining and quarrying industries, whose aperture walls are substantially abrasion resistant, to ensure retention of desired shape of the apertures for a considerably long period of time.

The present invention meets the aforesaid long felt need.

All through out the specification including the claims, the words "screen panel", "screen deck" "mining", "quarrying", "mineral", "ores", "walls", "button", "sleeve", "screening device", "screening deck", "abrasion resistant", "wear resistant" are to be interpreted in the broadest sense of the respective terms and includes all similar items in the field known by other terms, as may be clear to persons skilled in the art. Restriction/limitation, if any, referred to in the specification, is solely by way of example and understanding the present invention.

OBJECTS OF THE INVENTION

It is the principal object of the present invention to provide a screen panel with wear protective apertures, for its application in mining and quarrying industries, which is adapted to prevent/substantially reduce the wearing of its aperture walls, thereby increasing the life of the panel.

It is a further object of the present invention to provide a screen panel with wear protective apertures having a substantially higher longevity which is flexible and is adapted to form an integral resilient joint which enhances the abrasion resistant property of the apertured zone.

It is yet another object of the present invention to provide a screen panel with wear protective apertures having abrasion resistant metallic lining on the apertural walls, whereby the flexibility of said apertures is enhanced and wear protection is also ensured.

It is a further object of the present invention to provide a screen panel having flexible aperture walls, thereby facilitating the mineral ores to pass through the apertures easily and also ensuring prevention of clogging with the flaring or stepped design of aperture.

It is another object of the present invention to provide a method for manufacturing a a screen panel with wear protective apertures, for its application in mining and quarrying industries, which is adapted to prevent/substantially reduce the wearing of its aperture walls, thereby increasing the life of the panel.

It is a further object of the present invention to provide a screening deck for its application in the mining and quarrying industry, having mounted thereon at least a screen panel with wear protective apertures, for its application in mining and quarrying industries, which is adapted to prevent/substantially reduce the wearing of its aperture walls, thereby increasing the life of the panel.

It is a further object of the present invention to provide a screening deck for Its application in the mining and quarrying industry, having mounted thereon a plurality of screen panels with wear protective apertures, for its application in mining and quarrying industries, which is adapted to prevent/substantially reduce the wearing of its aperture walls, thereby increasing the life of the panel.

How the foregoing objects are achieved and the other aspects of the present invention will be clear from the following description which is purely by way of understanding and not by way of any sort of limitation.

SUMMARY OF THE INVENTION

Accordingly the present invention provides a screen panel with wear protective apertures for mining and quarrying industries adapted to be mounted on a screen deck, including a screening surface made up of materials such as herein described formed on a reinforcing frame, said screening surface having suitably designed apertures of desired shape for allowing materials of desired size to pass through, said apertures having walls made of abrasion resistant material such as herein described, said walls having plurality of slits cut along the vertical as well as horizontal line in the top and bottom portion of the apertural walls, whereby utmost flexibility of the apertures is ensured, simultaneously ensuring wear protection.

In accordance with preferred embodiments of the screen panel of the present invention:

- said abrasion resistant material includes metallic lining along walls of said apertures.
- said abrasion resistant material includes anyone of or a combination of ceramics and cryston.
- said walls with said slits along the vertical as well as horizontal line are adapted to be bonded to the inner wall of said apertures to form an integral resilient joint, said apertures having flaring and/or step design.

said slits are disposed along the entire length of the concerned said wall or along only a portion of it, such that the length of the slits on the lining of said wall is variable and or/fixed.

said screening surface, other than said apertures, are made of any one of or a combination of mild steel, stainless steel, rubber and/or polyurethane with or without steel reinforcing.

said panel comprises of vulcanized material, rubber polyurethane, having embedded within it steel reinforcing bars, at the outer edges of said panel and extended across the inner area of said panel, thereby providing support to said screening surface.

The present invention also provides a method of manufacturing a screen panel with wear protective apertures for mining and quarrying industries adapted to be mounted on a screen deck, including designing a screening surface made up of materials such as herein described formed on a reinforcing frame, said method further including making suitably designed apertures of desired shape on said screening surface, for allowing materials of desired size to pass through wherein the apertural walls are made of abrasion resistant material such as herein described and a plurality of slits are cut along the vertical as well as horizontal line in the top and bottom portion of the apertural walls, whereby utmost flexibility of the apertures is ensured simultaneously ensuring wear protection.

In accordance with preferred embodiments of the method of the present invention:

said slits are either cut along the entire length of the concerned wall or along only a portion of it such that lengths of said slits are variable and/or fixed and said walls with said slits along the vertical as well as horizontal line are bonded to the inner wall of said apertures to form an integral resilient joint, said apertures being shaped to have a flaring and/or stepped design.

The present invention also provides a screening deck for mining and quarrying industries, having mounted thereon a plurality of screen panels with wear protective apertures, each said panel including a screening surface made up of materials such as herein described formed on a reinforcing frame, said screening surface having suitably designed apertures of desired shape for allowing materials of desired size to pass through, said apertures having walls made of abrasion resistant material such as herein described said walls having plurality of slits cut along the vertical as well as horizontal line in the top and bottom portion of the apertural walls, whereby utmost flexibility of the apertures is ensured simultaneously ensuring wear protection.

BRIEF DESCRIPTION OF THE ACCOMPANYING DRAWINGS

The nature and scope of the present invention will be better understood from the accompanying drawings, which are by way of illustration of some preferred embodiments and not by way of any sort of limitation. In the accompanying drawings, FIG. 1 illustrates a plan view of the screen panel in accordance with a preferred embodiment of the present invention.

DETAILED DESCRIPTION OF THE INVENTION

Figure 1:
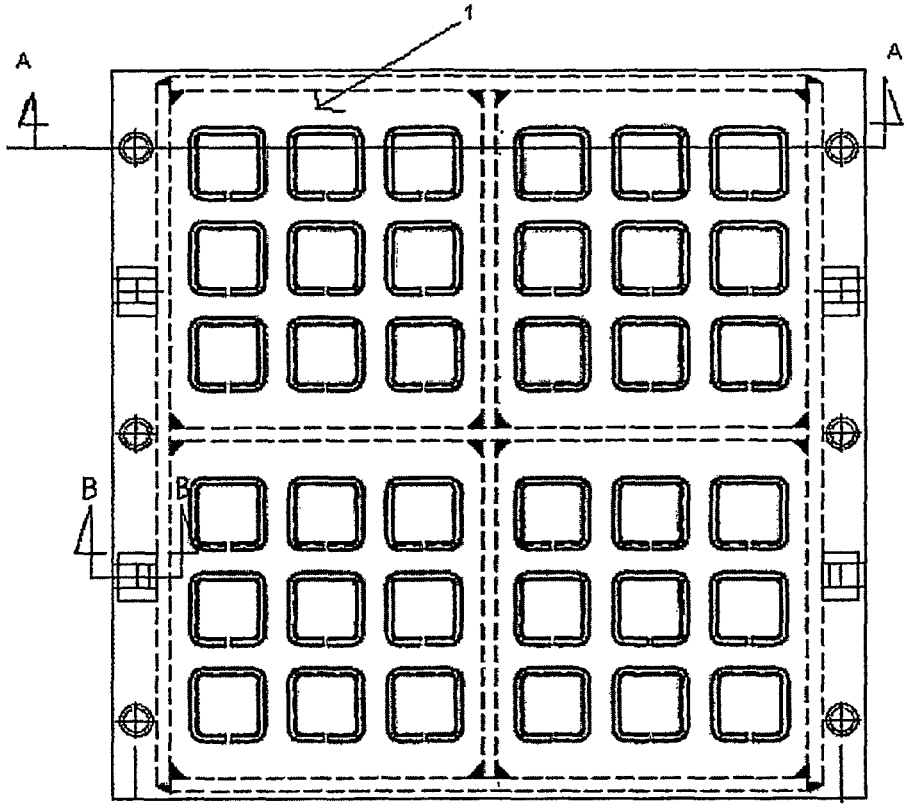

The following describes some preferred embodiments of the present invention, which are purely for the sake of understanding the performance of the invention, and not by way of any sort of limitation.

The present invention is aimed at providing screen panels with wear protective apertures, for its application in mining and quarrying industries. This ensures preventing/substantially reducing the wearing of the aperture walls, thereby increasing the life of the panels. The screen panels in accordance with the present invention, nullifies/substantially reduces the drawbacks of the screen panels known in the art, as discussed hereinbefore under the heading "Background of the Invention". The present invention focuses on reducing the abrasion of the aperture walls of the screen panels, so that the desired shapes thereof are retained for a considerably long period of time and simultaneously ensures flexibility of the apertures so that the mineral ores can pass through the apertures easily preventing clogging. Preferably to ensure this, the apertures are shaped to have a flaring and/or stepped design.

The screen panels are mounted on screen decks for causing screening/separating or grading of minerals in the mining and quarrying industries. Precisely, the present invention provides a flexible ore-screening panel adapted for mounting on a screening deck, which includes a screening surface integrally formed on a reinforcing frame. Such screen panel has aperture walls made up of abrasion resistant material, hitherto not conceived in the art, which facilitates resistance to abrasion and consequently ensures retention of desired shape of apertures, for a substantially long period of time. This in turn ensures longevity of the screen panels for performing the function of screening desired size range of materials. It would be clear to persons skilled in the art, that the shape of the apertures are designed according to the desired size range that is meant to be allowed to pass there through, depending upon the requirement. So, any distortion in the shape of the aperture, renders the whole screen panel in effective for performing such function. It is this aspect which the present invention rather stupendously ameliorates, which was hitherto not conceived in the industry. The walls of the apertures are constructed from abrasion resistant material, which is different from the rest of the screening surface of the screen panel.

To achieve the principal object of the present invention and its other objects the screening panel/device for screening mineral ores in accordance with the present invention, includes a screening surface of rubber/polyurethane combined with metallic walls in the apertures to provide both the flexibility of rubber/polyurethane along with harder metallic surface. The rubber/polyurethane helps to take the impact of the materials coming in contact with the screening surface whereas the metallic walls prevent wear of the apertures. Hence, the present invention advocates a complete and cohesive resonance effect, whereby not only is the desired shape of the apertures maintained for a substantially longer period of time due to reduction in abrasion, but also flexibility of the panels is ensured so that the materials of desired size can pass through the apertures. Furthermore, the metallic walls provided in the aperture walls are made such that it further adds on to the flexibility, thereby facilitating easy passage of mineral ores there through without any sort of clogging. Preferably to ensure this, the apertures are shaped to have a flaring and/or stepped design.

Preferably, the portion of the screening surface of the screen panel in accordance with the present invention, other than the apertures, are made of any one of or a combination of mild steel, stainless steel, robber and/or polyurethane with or without steel reinforcing.

Figure 2:
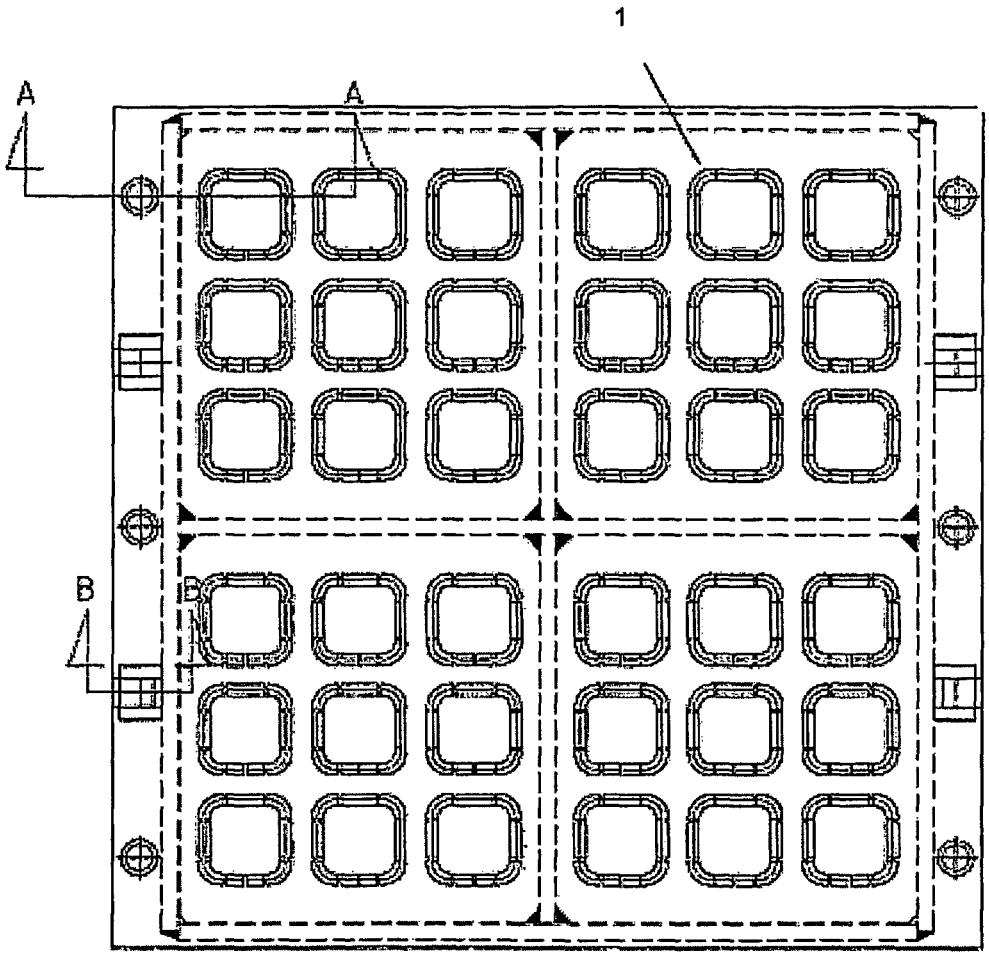
FIG. 2 illustrates a plan view of another preferred embodiment of the screen panel of the present invention.

The accompanying FIG. 1 illustrates a plan view of the screening surface of a preferred embodiment of a screen panel according to the present invention, showing the metallic walls of the aperture, in accordance with a preferred embodiment. The accompanying FIG. 1 shows the metallic Walls having plurality of slits (1) cut along the vertical line in the top and bottom portion. The accompanying FIG. 2 illustrates slits cut along the vertical as well as the horizontal line in the top and bottom portion. These features give the utmost flexibility of the apertures apart from the advantage of wear protection. The slits are either cut along the entire length of the concerned wall or along only a portion of it. The length of the slits may therefore be variable and/or fixed.

Figure 3:
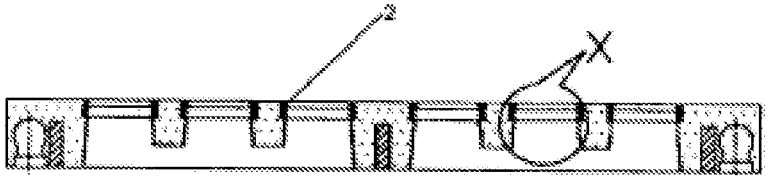
FIG. 3 illustrates a sectional side view of the screen panel in FIG. 1 along the line A-A.
Figure 4:
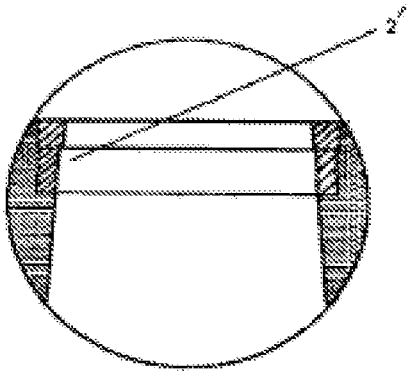
FIG. 4 illustrates an enlarged view of the portion marked X in FIG. 3.
Figure 5:
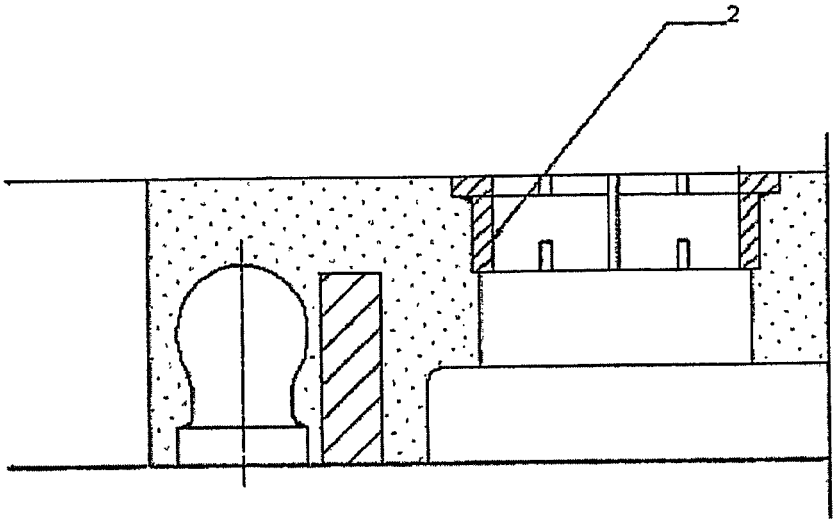
FIG. 5 illustrates a sectional view of the screen panel illustrated in FIG. 2 along the line A-A.
Figure 6:
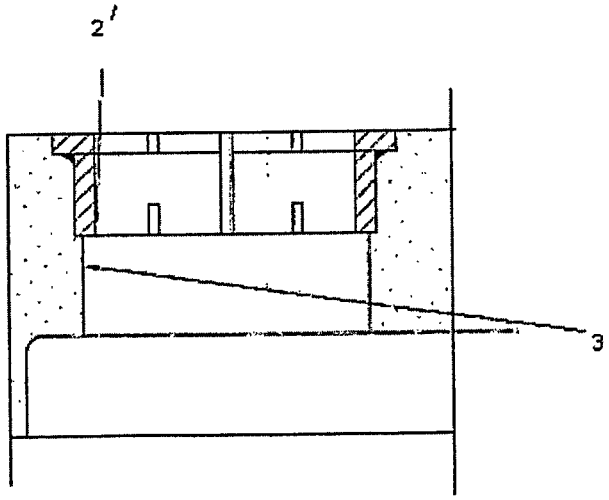
FIG. 6 illustrates an enlarged view of a portion of the sectional view illustrated in FIG. 5.

The accompanying FIG. 3 illustrates a sectional side view of the screen panel illustrated in the accompanying FIG. 1 along the line A-A. It shows the metallic protective wall (2). The accompanying FIG. 4 illustrates an enlarged view of the portion marked X in the accompanying FIG. 2. It illustrates metallic protective apertural wall with flaring and stepped design (2'). As stated before the apertures as shown in the accompanying FIG. 4 are shaped to have a flaring and/or stepped design to facilitating adding on to the flexibility and ensuring easy passage of mineral ores there through without any sort of clogging. The accompanying FIGS. 5 and 6 illustrate sectional views of the screen panel according to the present invention, which shows the configuration of the metallic protective apertural walls (2) of the present Invention. The accompanying FIG. 5 illustrates a sectional view taken along the line A-A in the accompanying FIG. 2. The accompanying FIG. 6, in particular, illustrates the metallic protective wall (2') inside the stepped aperture and the step (3) feature of the aperture. This figure is an enlarged view of a portion of the accompanying FIG. 5.

Preferably, the panel is hot vulcanized material, rubber/polyurethane, having embedded within it steel reinforcing bars at the outer edges of the panels and extended across the inner area of the panel to provide support to the screening surface. In this arrangement the apertures used for screening the undersize ores are lined with metallic walls (2, 2') as illustrated in the accompanying FIGS. 3, 4, 5 and 6. As illustrated in the accompanying FIGS. 1 and 2 and as stated before, the metallic walls have plurality of slits(1) cut along the vertical line as well as the horizontal line in the top and bottom portion which give the utmost flexibility of the apertures apart from the advantage of wear protection. The slits are either cut along the entire length of the concerned wall or along only a portion of it so that the length of the slits is variable and/or fixed. The metallic protective walls with several slits along the vertical as well as horizontal line are bonded to the inner wall of the aperture such that it produces an integral resilient joint. Preferably, the apertures are shaped to have a flaring and/or stepped design as shown in the accompanying FIGS. 4 and 6. These features coherently, enhance the abrasion resistance property of the apertured zone and at the same time flexibility is ensured facilitating the mineral ores to pass through the apertures, easily without any sort of clogging.

In the above context it is hereby clarified, that simply by way of example and for understanding the present invention and riot by way of any limitation, the abrasion resistance walls of the apertures have been explained and stated as metallic. It should be understood to persons skilled in the art that, the walls may be made of other abrasion resistant material as well such as ceramic, cryston or any other highly wear resistant material. These materials can be used for any length along the aperture wall. The thickness of these plates can be anything depending on the aperture size. The present invention is equally effective, in achieving its principal objective as well as its other objectives, on application of any such wear/abrasion resistant material either individually or in combination.

The method of manufacturing a screen panel with wear protective apertures in accordance with the present invention includes, designing a screening surface made up of materials such as herein described formed on a reinforcing frame. The method also includes making suitably designed apertures of desired shape on the screening surface, for allowing materials of desired size to pass through. The apertural walls are made of abrasion resistant material such as herein described. A plurality of slits are cut along the vertical as well as horizontal line in the top and bottom portion of the apertural walls, whereby utmost flexibility of the apertures is ensured simultaneously ensuring wear protection. Preferably the slits are either cut along the entire length of the concerned wall or along only a portion of it so that the lengths of the slits are variable and/or fixed. Furthermore, the walls with said slits along the vertical as well as horizontal line are bonded to the inner wall of said apertures to form an integral resilient joint and the apertures are preferably shaped to have a flaring and/or stepped design.

The present invention is applicable for all desired shapes of apertures, as required in the industry. The panels may be of different sizes, i.e.—modular type (305×305 mm and 610×300 mm) and larger sizes also. For modular type snap on type fixing, like button type, pin and sleeve type may be provided for mounting on to the screen deck.

The present invention has been described with reference to some drawings and preferred embodiments, purely for the sake of understanding and not by way of any limitation and the present invention includes all legitimate developments within the scope of what has been described hereinbefore and claimed in the appended claims.

I claim:

1. A screen panel with wear protective apertures for mining and quarrying industries adapted to be mounted on a screen deck, including a screening surface made up of materials such as herein described formed on a reinforcing frame, said screening surface having suitably designed apertures of desired shape for allowing materials of desired size to pass through, said apertures having walls including a plate made of abrasion resistant material such as herein described, said plate having plurality of notches cut along the vertical as well as horizontal line in the top and bottom portion of said plate, wherein a first and a second notch are separated by a portion of the plate extending vertically between the first and second notches, whereby utmost flexibility of the apertures is ensured, simultaneously ensuring wear protection.

2. The screen panel as claimed in claim 1, wherein said abrasion resistant material includes metallic lining along walls of said apertures.

3. The screen panel as claimed in claim 1, wherein said abrasion resistant material includes anyone of or a combination of ceramics and cryston.

4. The screen panel as claimed in claim 1, wherein said plates with said notches along the vertical as well as horizontal line are adapted to be bonded to the inner wall of said apertures to form an integral resilient joint, said apertures being stepped apertures.

5. The screen panel as claimed in claim 4, wherein said notches are disposed along the entire length of the concerned said plate or along only a portion of it such that the length of the notches on the lining of said plate is variable and or/fixed.

6. The screen panel as claimed in claim 1, wherein said screening surface, other than said apertures, are made of any one of or a combination of mild steel, stainless steel, rubber and/or polyurethane with or without steel reinforcing.

7. The screen panel as claimed in claim 1, wherein said panel comprises of vulcanized material, rubber polyurethane, having embedded within it steel reinforcing bars, at the outer edges of said panel and extended across the inner area of said panel, thereby providing support to said screening surface.

8. A method of manufacturing a screen panel with wear protective apertures for mining and quarrying industries adapted to be mounted on a screen deck, including designing a screening surface made up of materials such as herein described formed on a reinforcing frame, said method further including making suitably designed apertures of desired shape on said screening surface for allowing materials of desired size to pass through, wherein the apertural walls include a plate made of abrasion resistant material such as herein described; and notching the plate at opposed vertical end portions of the plate, whereby utmost flexibility of the apertures is ensured simultaneously ensuring wear protection.

9. The method as claimed in claim 8, wherein said notches are either cut along the entire length of the plate or along only a portion of it such that lengths of said notches are variable and/or fixed and said plates with said notches along the vertical as well as horizontal line are bonded to the inner wall of said apertures to form an integral resilient joint, said apertures being shaped to have a stepped design.

10. A screening deck for mining and quarrying industries, having mounted thereon a plurality of screen panels with wear protective apertures, each said panel including a screening surface made up of materials such as herein described formed on a reinforcing frame, said screening surface having suitably designed apertures of desired shape for allowing materials of desired size to pass through, said apertures having plates made of abrasion resistant material such as herein described, said plates having a plurality of notches cut along the vertical as well as horizontal line in the top and bottom portion of plate, wherein a first and a second notch are separated by a portion of the plate extending vertically between the first and second notches, whereby utmost flexibility of the apertures is ensured simultaneously ensuring wear protection.

11. A screen panel as recited in claim 1, wherein the first and second notches are bounded on three sides by the plate.

12. A screen panel as recited in claim 1, wherein the first notch is open at its top end and spanned at its lower end by the plate.

13. A screen panel as recited in claim 1, wherein the second notch is open at its bottom end and spanned at its upper end by the plate.

14. A screen panel as recited in claim 1, wherein the plate extends about the aperture wall such that opposite ends of the plate face one another.

* * * * *